US006944416B2

(12) United States Patent
Watanabe

(10) Patent No.: US 6,944,416 B2
(45) Date of Patent: Sep. 13, 2005

(54) IMAGE FORMING APPARATUS

(75) Inventor: Yasunari Watanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 10/670,254

(22) Filed: Sep. 26, 2003

(65) Prior Publication Data

US 2004/0109705 A1 Jun. 10, 2004

(30) Foreign Application Priority Data

Sep. 30, 2002 (JP) ..... 2002-285438

(51) Int. Cl.[7] ..... G03G 21/00
(52) U.S. Cl. ..... 399/129; 399/149; 399/150
(58) Field of Search ..... 399/127, 129, 399/130, 149, 150

(56) References Cited

U.S. PATENT DOCUMENTS 6,215,967 B1 * 4/2001 Takeda et al. ..... 399/43
6,345,162 B1 * 2/2002 Ozawa et al. ..... 399/61
6,421,512 B2 7/2002 Watanabe et al. ..... 399/149
6,603,941 B2 8/2003 Watanabe et al. ..... 399/129
6,611,668 B2 8/2003 Watanabe et al. ..... 399/129
6,807,384 B2 * 10/2004 Okubo et al. ..... 399/50
2003/0059231 A1 3/2003 Watanabe et al. ..... 399/129
2003/0147659 A1 8/2003 Yoshikawa et al. ..... 399/44

* cited by examiner

*Primary Examiner*—Hoan Tran
(74) *Attorney, Agent, or Firm*—Fitzpatrick, Cella, Harper & Scinto

(57) ABSTRACT

A cleaner-less image forming apparatus serves to prevent excessive expellation of toner from a photosensitive drum at the time of application of a bias voltage. A developer charging member for charging residual toner on the photosensitive drum is disposed in contact with the photosensitive drum at a location downstream of a transfer device and upstream of a charging device in a direction in which the photosensitive drum is rotating. A DC voltage of a polarity opposite to a normal charging polarity of the developer is applied to the developer charging member and has a slope whose absolute value at the start of voltage application is selectable from a first value and a second value which is greater than the first value.

21 Claims, 5 Drawing Sheets

| | PERIOD OF TIME UNTIL BIAS VOLTAGE BICOMES STEADY STATE | SLOPE OF APPLIED VOLTAGE | EXPELLATION OF TONER FROM TONER CHARGE AMOUNT CONTROL DEVICE |
|---|---|---|---|
|   | 0.05 SEC | 8000 V/SEC | YES |
|   | 0.10 SEC | 4000 V/SEC | YES |
|   | 0.15 SEC | 2667 V/SEC | YES (SMALL AMOUNT) |
|   | 0.20 SEC | 2000 V/SEC | NO |
|   | 0.25 SEC | 1600 V/SEC | NO |

| | PERIOD OF TIME UNTIL BIAS VOLTAGE BICOMES STEADY STATE | SLOPE OF APPLIED VOLTAGE | EXPELLATION OF TONER FROM TONER CHARGE AMOUNT CONTROL DEVICE |
|---|---|---|---|
|  | 0.1 SEC | -8000 V/SEC | YES |
|  | 0.2 SEC | -4000 V/SEC | YES |
|  | 0.3 SEC | -2666.7 V/SEC | YES |
|  | 0.4 SEC | -2000 V/SEC | NO |
|  | 0.5 SEC | -1600 V/SEC | NO |

IMAGE FORMING APPARATUS

This application claims the right of priority under 35 U.S.C. § 119 based on Japanese Patent Application No JP 2002-285438, filed on Sep. 30, 2002 which is hereby incorporated by reference herein in its entirety as if fully set forth herein.

BACKGROUND OF THE INVENTION

1. Field of the Invention

The present invention relates to an image forming apparatus such as a copying machine, a printer, etc. More specifically, the present invention is preferably applied to an image forming apparatus of the cleaner-less type where developer (toner) remaining on an image bearing member after a transfer process is removed and collected for reuse simultaneously by development and cleaning in a developing device, thus eliminating a cleaning device.

2. Description of the Related Art

Image forming apparatus using transfer type electrophotography such as copying machines, printers, and facsimile machines have hitherto been known. Such an image forming apparatus generally comprises a photosensitive member as an image bearing member which is generally a rotating drum, a charging device for uniformly charging the photosensitive member in a predetermined polarity and at a predetermined potential (charging process), an electrostatic latent image forming device, that is, an exposure device for forming an electrostatic latent image on the charged photosensitive member (exposing process), a developing device for visualizing by developer (toner) the electrostatic latent image formed on the photosensitive member (developing process), a transfer device for transferring the toner image from the photosensitive member onto a transfer material such as paper (transfer process), a cleaning device for removing a little amount of toner remaining on the photosensitive member after the transfer process to clean the surface of the photosensitive member (cleaning process), a fixing device for fixing the toner image on the transfer material (fixing process), and the like. The photosensitive member is repeatedly used in image formation in the electrophotographic process (the charging process, the exposing process, the developing process, the transfer process, and the cleaning process).

The toner remaining on the photosensitive member after the toner image is transferred onto the transfer material is removed from the surface of the photosensitive member by the cleaning device. The removed toner is collected by and in the cleaning device. The collected toner accumulates in the cleaning device as waste toner. However, from the viewpoint of environment conservation, effective use of resources, and the like, it is preferable that no waste toner is generated.

Thus, there have been known image forming apparatus which return waste toner accumulated in the cleaning device to the developing device to reuse the toner in the developing device Cleaner-less image forming apparatus, which eliminate the cleaning device, are also known. A cleaner-less image forming apparatus removes toner remaining on a photosensitive member by the developing device after the transfer process, so that the removed toner is collected in the developing device and reused in the developing device. In such a cleaner-less image forming apparatus, the developing device cleans up the toner remaining on the photosensitive member simultaneously with development of an electrostatic latent image (cleaning simultaneous with developing)

The cleaning simultaneous with developing is a method in which residual toner, that is, toner which is not transferred by the transfer device and is remaining on the photosensitive member, is collected in the developing device in following developing processes. More specifically, the photosensitive member having residual toner thereon is subsequently charged by a charging device, and an electrostatic latent image is formed on the surface of the photosensitive member by an exposure device, whereafter the electrostatic latent image is developed by the developing device. Simultaneously with the development of the electrostatic latent image by the developing device, part of the toner on a non-exposed portion among the toner remaining on the photosensitive member without being developed is collected in the developing device by application of a fog removal bias voltage (fog removal potential difference Vback in the form of a potential difference between the direct current voltage applied to the developing device and the surface potential of the photosensitive member).

According to this method, the residual toner is collected in the developing device and used in following developing processes. Thus, no waste toner is generated, and troublesome maintenance for collecting waste toner is eased. Further, since the cleaning device is unnecessary, this method is also effective in reducing the size of the image forming apparatus.

However, in case where the charging device comprises a contact charging device which is in contact with the surface of the photosensitive member to charge the photosensitive member, when residual toner on the photosensitive member passes through contact portions (charging portion) of the photosensitive member and the contact charging device, part of the residual toner (reversal toner), which is charged to a polarity opposite to a normal polarity of toner, attaches to the contact charging device. As a result, the contact charging device is contaminated by toner to an unacceptable level, and hence the charging device becomes unable to sufficiently charge the photosensitive member.

In view of these circumstances, the present inventors proposed an image forming apparatus of the cleaner-less type which, when the charging device is a contact charging device, is free from defective charging and a poor image by preventing residual toner from attaching to the charging device and by efficiently collecting the residual toner by means of the developing device, and which offers benefits of a cleaner-less image forming system (see U.S. Pat. No. 6,421,512).

The above-mentioned image forming apparatus includes a first developer charge amount control device (first developer charging member) arranged on the downstream side of a transfer device in a rotational direction of a photosensitive member for charging residual developer on the photosensitive member, and a second developer charge amount control device (second developer charging member) arranged on the downstream side of the first developer charge amount control device and on the upstream side of the charging device for charging the residual developer on the photosensitive member. The first developer charge amount control device charges the residual developer, that is, the developer which is remaining on the photosensitive member without being transferred by the transfer device, to a polarity opposite to the normal polarity of the developer (toner). Then, the second developer charge a mount control device charges the residual developer, which was charged to the opposite polarity to the normal polarity of the developer, to the normal polarity. Thereafter, the charging device charges the photosensitive member, and at the same time, appropriately charges the residual developer.

As a result, the residual developer is prevented from attaching to the charging device, and the developing device efficiently collects the residual developer, whereby it is possible to provide an image forming apparatus which is free from defective charging and a poor image while offering benefits of a cleaner-less image forming system.

However, in case where a developer charge amount control device is in contact with a photosensitive member, a some small amount of developer may remain on the contact (nip) portions of the developer charge amount control device and the photosensitive member. At the instant when a bias voltage is applied to the developer charge amount control device, and/or at the instant when the application of a bias voltage is stopped, the residual developer no longer stays on the contact portions of the photosensitive member and the developer charge amount control device, and is transferred onto the photosensitive member, thus resulting in formation of a poor image. In order to prevent such a situation, U.S. Publication No. 2003-59231 proposes that the slope of a bias voltage applied be defined appropriately.

Even if, however, an appropriate bias voltage is applied so as to prevent the transfer of the residual developer (toner) to the photosensitive member, when the amount of the toner remaining on the contact portions of the photosensitive member and the developer charge amount control device exceeds a prescribed value, the developer charge amount control device is contaminated by part of the toner of high resistance, resulting the cause of defective charging.

SUMMARY OF THE INVENTION

An object of the present invention is to provide an image forming apparatus which is capable of preventing a defective image resulting from developer remaining on an image bearing member.

Another object of the present invention is to provide an image forming apparatus which is capable of transferring developer from a developer charging member onto an image bearing member.

A further object of the present invention is to provide an image forming apparatus which has a plurality of slopes for a DC voltage applied to a developer charging member at the start of application thereof.

A still further object of the present invention is to provide an image forming apparatus which is capable of making appropriate the charge amount of residual developer on an image bearing member.

A yet further object of the present invention is to provide an image forming apparatus suitable for a cleaner-less system without a dedicated cleaner.

The above and other objects, features and advantages of the present invention will become more apparent from the following detailed description of a preferred embodiment of the present invention taken in conjunction with the accompanying drawings.

DETAILED DESCRIPTION OF THE PREFERRED EMBODIMENTS

Now, a preferable embodiment of the present invention will be described in detail, by way of example, while referring to the accompanying drawings. Here, it is to be noted that the sizes, materials, shapes, relative arrangements and the like, of components described herein are not intended to limit the scope of the present invention unless otherwise specifically stated.

(First Embodiment)

Figure 1:
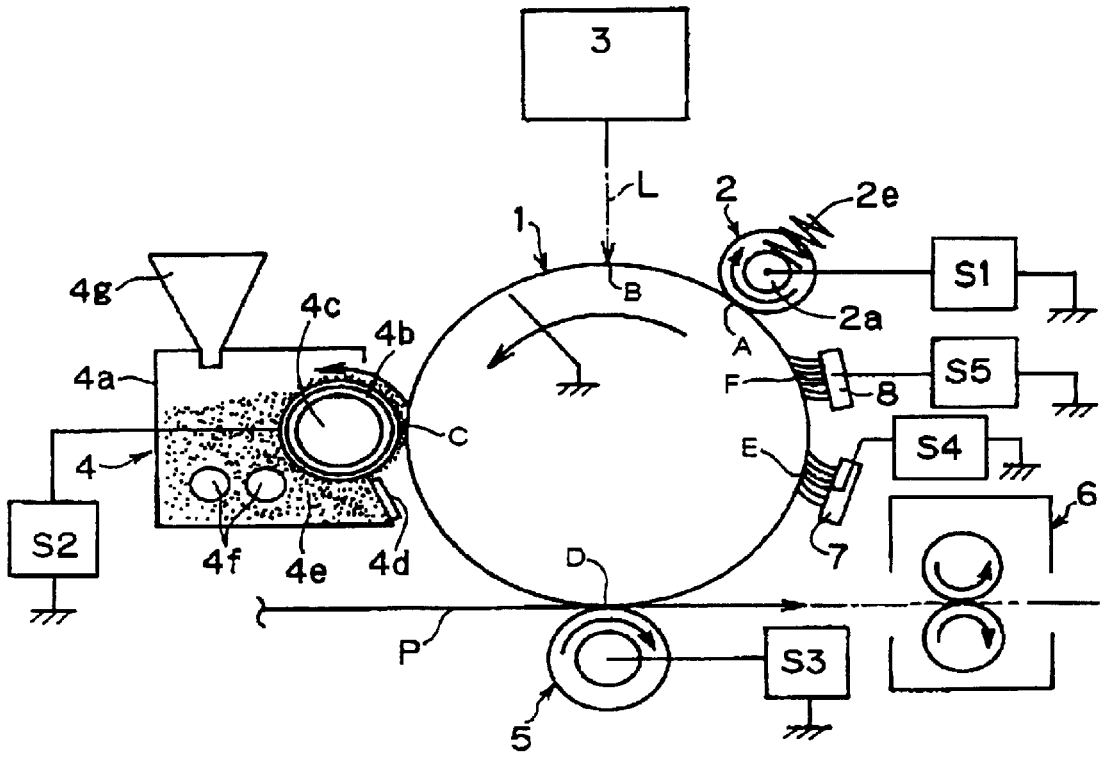
FIG. 1 is a schematic view illustrating the structure of an image forming apparatus according to an embodiment of the present invention.
Figure 2:
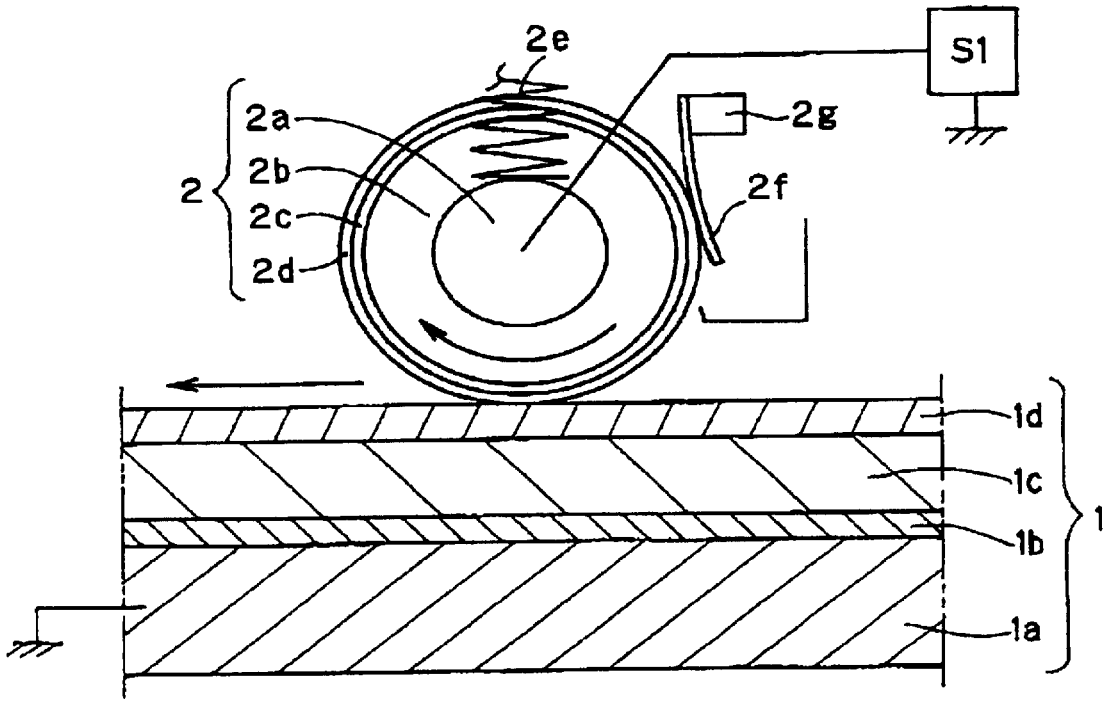
FIG. 2 is a schematic view illustrating the layer structure of a photosensitive drum and a charging roller.

FIG. 1 is a schematic sectional view of an image forming apparatus according to the present invention. FIG. 2 is a sectional view illustrating the layer structure of an image bearing member and a charging device according to the present invention. A schematic overall structure of a printer will be described below with reference to FIG. 1.

(a) Image Bearing Member

In FIG. 1, an image bearing member 1 comprises an electrophotographic photosensitive member of the rotating drum type (hereinafter referred to as a photosensitive drum). The photosensitive drum 1 is formed of an organic photo conductor (OPC) having an outside diameter of 50 mm, which can be charged to a negative polarity. The photosensitive drum 1 is driven to rotate about a support shaft at a process speed (circumferential speed) of 100 mm/sec in a counterclockwise direction, as shown at an arrow in this figure.

As illustrated in FIG. 2, the photosensitive drum 1 is constructed such that three layers, comprising an underlayer 1*b* for suppressing interference of light and improving adhesion of an upper layer, a charge generation layer 1*c* and a charge transport layer 1*d*, are coated in this order on the surface of a cylinder 1*a* made of aluminum (conductive drum base).

(b) Charging Device

A contact charging device uniformly charges the peripheral surface of the photosensitive drum 1. In this embodiment, the contact charging device comprises a charging roller 2 which can be brought into contact with the photosensitive drum 1.

The charging roller 2 has a core 2*a* rotatably held at both ends thereof by a pair of bearings (not shown). A compression spring 2*e* biases or urges the charging roller 2 toward the photosensitive drum 1, so that the charging roller 2 is placed in pressure contact with the surface of the photosensitive drum 1 at a predetermined pressing force, whereby the charging roller 2 is caused to rotate following the rotation of the photosensitive drum 1. Those portions of the photo sensitive drum 1 and the charging roller 2 which are in pressure contact with each other constitute a charging portion (charging nip portion) A (see FIG. 1).

A power supply S1 applies a predetermined charging bias voltage to the core 2*a* of the charging roller 2, so that the peripheral surface of the photosensitive drum 1 is thereby charged to a predetermined polarity and at a predetermined potential.

In this embodiment, the charging bias voltage applied to the charging roller 2 is an oscillating voltage which is formed by superimposing an AC voltage (Vac) on a DC voltage (Vdc).

More specifically, the charging bias voltage is an oscillating voltage formed by superimposing an AC voltage of a sinusoidal voltage waveform having a frequency f of 1,000 Hz and a peak-to-peak voltage Vpp of 1,400V on a DC voltage of −500 V. By application of such a charging bias voltage, the peripheral surface of the photosensitive drum 1 is uniformly charged at a voltage of −500 V (dark potential Vd).

The charging roller 2 has a longitudinal length of 320 mm, and is of a three layer structure having an underlayer 2*b*, an intermediate layer 2*c*, and a surface layer 2*d* stacked or laminated in this order on the peripheral surface of the core (support member) 2*a*, as illustrated in the layer structure sectional view of FIG. 2. The underlayer 2*b* comprises a foamed sponge layer for reducing noise generated upon charging, and the intermediate layer 2*c* comprises a conductive layer for obtaining uniform resistance for the entire charging roller 2. Also, the surface layer 2*d* comprises a protective layer provided for preventing leakage even if the photosensitive drum 1 has defects thereon such as pin holes.

More specifically, specifications of the charging roller 2 according to this embodiment are as follows:

Core 2*a*: round bar made of stainless steel having a diameter of 6 mm;

Underlayer 2*b*: foamed EPDM with carbon dispersed therein having a specific gravity of 0.5 g/cm$^3$, a volume resistivity of 1–10$^7$ Ω·m (10$^2$–10$^9$ Ω·cm), a layer thickness of 3.0 mm, and a length of 320 mm;

Intermediate layer 2*c*; NBR rubber with carbon dispersed therein having a volume resistivity of 1–10$^4$ Ω·m (10$^2$–10$^6$ Ω·cm), and a layer thickness of 700 μm;

Surface layer 2*d*; TORESIN resin of a fluorine compound with tin oxide and carbon dispersed therein having a volume resistivity of 10$^5$–10$^8$ Ω·m (10$^7$–10$^{10}$ Ω·cm), a surface roughness (average surface roughness Ra at ten different points according to the JIS standard) of 1.5 μm and a layer thickness of 10 μm.

In this embodiment, as illustrated in FIG. 2, a cleaning film (charging roller cleaning member) 2*f* is flexible. The cleaning film 2*f* is fixedly secured at one end thereof to a support member 2*g*, which is arranged in parallel to the longitudinal direction of the charging roller 2 and reciprocates over a fixed amount or distance in the longitudinal direction, in such a manner that it cooperates with the charging roller 2 to form a contact nip on a portion of its surface in the vicinity of a free end thereof.

The support member 2*g* is driven by an unillustrated drive motor of the printer through an unillustrated gear train to reciprocate over the fixed distance in the longitudinal direction of the charging roller 2, in accordance with which the cleaning film 2*f* slides on and along the surface layer 2*d* of the changing roller 2. As a result, contaminants such as fine powder toner, external additives, and the like attached to the surface layer 2*d* are removed by the sliding cleaning film 2*f*.

Preferably, the cleaning film 2*f* is made of a resin or a material which is adapted to triboelectrically charge the toner attached to the surface of the charging roller 2 to a normal polarity. In addition, as illustrated in FIG. 2, the cleaning film 2*f* is preferably arranged to have a clearance formed between its free end and the surface of the charging roller 2, so that the toner on the charging roller 2 can be dispersed by the cleaning film 2*f*. Thus, the toner attached to the charging roller 2 is charged to the normal charge polarity while being dispersed by the cleaning film 2*f*. The toner charged in the normal charge polarity is returned from the charging roller 2 to the photosensitive drum 1 due to a potential difference between the voltage applied to the charging roller 2 and the potential of the photosensitive drum 1.

(c) Electrostatic Latent Image Forming Device

A laser beam scanner (electrostatic latent image forming device) 3 is an exposure device for forming an electrostatic latent image on the surface of the charged photosensitive drum 1 using a semiconductor laser. The laser beam scanner 3 outputs laser beams which are modulated correspondingly to image signals sent from a host device such as an image reading apparatus (not shown) to the printer side, so that laser scanning exposure L (image exposure) is performed on the uniformly charged surface of the photosensitive drum 1 at an exposure position B. Since the potential of a place on the surface of the photosensitive drum 1 which is irradiated by laser beams through the laser scanning exposure L is lowered, there is gradually formed on the surface to the photosensitive drum 1 an electrostatic latent image which corresponds to image information being scanned and exposed.

(d) Developing Device

A developing device 4 supplies developer (toner) to the electrostatic latent image formed on the surface of the photosensitive drum 1 thereby to visualize the electrostatic latent image. In this embodiment, the developing device 4 is a reverse developing device using a two-component magnetic brush developing system. Specifically, the developing device 4 is constructed as follows.

A non-magnetic developer bearing member in the form of a developing sleeve 4*b* is rotatably arranged inside a developing container 4*a* with part of its peripheral surface exposed to the outside. A magnet roller 4*c* is inserted in the developing sleeve 4*b* and fixed thereto against rotation relative thereto. A developer coating blade 4*d* limits the amount of developer. A two-component developer 4*e* is contained in the developing container 4*a*. A plurality of developer agitating members 4*f* are arranged at lower locations in the developing container 4*a*. A toner hopper 4*g* contains toner to be replenished to the developing container 4*a*.

The two-component developer 4*e* contained in the developing container 4*a* includes a toner and a magnetic carrier, which are agitated by the developer agitating members 4*f*. In this embodiment, the magnetic carrier has a volume resistivity of about 10$^{11}$ Ω·m (10$^{13}$ Ω·cm), and a particle size of about 40 μm. The toner is triboelectrically charged to a negative polarity by friction with the magnetic carrier. That is, the normal polarity of the charged toner is the same as the charging polarity of the charging roller 2.

The developing sleeve 4*b* is arranged in opposition to the photosensitive drum 1 at a proximal location while maintaining the closest possible distance (hereinafter referred to as S-Dgap) of 350 μm between itself and the photosensitive drum 1. Those portions of the photosensitive drum 1 and the developing sleeve 4*a* which are opposed to each other constitute a developing portion C. The developing sleeve 4*b* is driven by friction at the developing portion C to rotate in a direction opposite to the direction of rotation of the photosensitive drum 1.

Part of the two-component developer 4*e* is held as a magnetic brush layer on the peripheral surface of the developing sleeve 4*b* by the magnetic force of the magnet roller 4*c* in the developing sleeve 4*b*. The magnetic brush layer is transported in accordance with the rotation of the developing sleeve 4*e*, and is limited to have a predetermined thickness by the developer coating blade 4*d*. The magnetic brush layer thus limited in its thickness comes in contact with the surface of the photosensitive drum 1 at the developing portion C to slides on and along the surface of the photosensitive drum 1 at an appropriate pressure. A power supply S2 applies a predetermined developing bias voltage to the developing sleeve 4*b*.

In this embodiment, the developing bias voltage applied to the developing sleeve 4*b* is an oscillating voltage which is formed by superimposing an AC voltage (Vac) on a DC voltage (Vdc). More specifically, it is an oscillating voltage formed by superimposing an AC voltage of 1,600 V on a DC voltage of −350 V.

The two-component developer 4*e* is coated as a thin layer on the surface of the rotating developing sleeve 4*b* and is transported to the developing portion C where the toner contained in the two-component developer 4*e* is selectively attached to those portions of the surface of the photosensitive drum 1 which correspond to the electrostatic latent image formed thereon under the action of an electric field generated by the developing bias voltage, thus developing the electrostatic latent image as a toner image. In this embodiment, the electrostatic latent image is developed as the toner image by using a so-called reversal developing system, that is, a system in which an image portion on the surface of the photosensitive drum 1 is exposed by the exposure device to remove the electric charge thereon, whereby toner is attached to the charge-removed portion of the photosensitive drum surface.

The two-component developer 4*e* on the developing sleeve 4*b*, having passed through the developing portion C, is returned to a developer reservoir portion in the developing container 4*a* in accordance with the rotation of the developing sleeve 4*b*.

In order to maintain the toner density of the two-component developer 4*e* in the developing container 4*a* in a predetermined fixed range, the toner density is detected, for example, by an optical toner density sensor (not shown). The toner hopper 4*g* is controlled and driven in accordance with the information thus detected, so that the toner contained in the toner hopper 4*g* is replenished to the two-component developer 4*e* in the developing container 4*a*. The toner supplied in this manner is agitated by the agitating members 4*f* in the developing container 4*a*.

(e) Transfer Device/Fixing Device

In this embodiment, a transfer roller 5 is used as a transfer device. The transfer roller 5 is pressed against the photosensitive drum 1 with a predetermined pressing force, and the press-contacting nip portions of the transfer roller 5 and the photosensitive drum 1 constitute a transfer portion D. A transfer material (i.e., a member to which toner is transferred, or a recording material) P, which is an image receiving member, is fed to the transfer portion D from a paper feed portion or mechanism (not shown) at predetermined control timing.

The transfer material P fed to the transfer portion D is transported while being sandwiched between the rotating photosensitive drum 1 and the rotating transfer roller S. During the transfer material P is being sandwiched in this manner, a power supply S3 applies to the transfer roller 5 a transfer bias voltage of a positive polarity which is opposite to the normal charging polarity, i.e., negative polarity, of toner. In this embodiment, by applying a voltage of +2 kV to the transfer roller 5, the toner image on the photosensitive drum 1 is gradually and electrostatically transferred onto the transfer material P at the transfer portion D.

The transfer material P with the toner image transferred thereon at the transfer portion D is gradually separated from the surface of the photosensitive drum 1, and is transported to a fixing device 6 (heat roller fixing device, for example). The fixing device 6 fixes the toner image transferred onto the transfer material P, and outputs it as an image forming object (printed or copied matter).

(f) Cleaner-Less System and Toner Charge Amount Control

The printer of this embodiment is of a cleaner-less type, and is not provided with a dedicated cleaning device for removing a small amount of toner, i.e., so-called residual toner, remaining on the surface of the photosensitive drum 1 after the toner image is transferred to the transfer material P. As the photosensitive drum 1 continues to rotate, the residual toner is transported to the developing portion C through the charging portion A and the exposing portion B. The developing device 4 performs cleaning (collecting) of the residual toner simultaneously with developing (cleaner-less system). More specifically, a first electric field is formed for attaching the toner on the developing sleeve 4*b* to the exposing portion of the photosensitive drum 1, and at the same time, a second electric field is formed in a direction to collect toner from a non-exposed portion of the photosensitive drum 1 to the developing sleeve 4*b*. Here, note that the residual toner may be collected from the photosensitive member or drum 1 to an intermediate transfer member and/or a transfer material bearing member which are in contact with the photosensitive member.

The residual toner on the photosensitive drum 1 passes through the exposing portion B, so the photosensitive drum 1 is exposed by the laser beam scanner 3 through the residual toner, but this does not have much effect since the amount of the residual toner is small.

However, as described above, the residual toner includes a toner of the normal charging polarity, a toner of a polarity opposite to the normal polarity (reversal toner), and a toner with a little or no amount of charge. Among the residual toner, the reversal toner or the toner with a little or no amount of charge, when passing through the charging portion A, is attached to the charging roller 2 whereby the charging roller 2 is contaminated more than an acceptable level and becomes unable to sufficiently charge the photosensitive drum 1.

In addition, in order for the developing device 4 to effectively cleanup the residual toner simultaneously with developing, it is preferable that the residual toner transported to the developing portion C have the normal charging polarity, and the amount of charge thereof be large enough to develop the electrostatic latent image on the photosensitive drum 1 by means of the developing device 4. The reversal toner and the toner with an inappropriate amount of charge can not be removed and collected from the surface of the photosensitive drum 1 to the developing device 4, thus resulting in a cause of a poor image.

Further, as users' needs are being diversified in recent years, continuous print operation of an image having a high print rate such as a photographic image generates at one time a large amount of residual toner on the photosensitive drum 1, which increases formation of poor images.

Accordingly, in this embodiment, in order to distribute the residual toner on the photosensitive drum 1 uniformly and to charge all the toners remaining after being transferred to a negative polarity which is the normal polarity, a first toner charge amount control device (first developer charging member) 7 and a second toner charge amount control device (second developer charging member) 8 are provided on the downstream side of the transfer portion D and on the upstream side of the charging portion A in the rotational direction of the photosensitive drum 1.

In this embodiment, the first toner charge amount control device 7 and the second toner charge amount control device 8 are each provided with a brush-like member having appropriate conductivity with a voltage being applied thereto. The brush-like members have their brush portions arranged in contact with the surface of the photosensitive drum 1. Preferably, each of the brush-like members comprises a fiber brush member.

A voltage of a positive polarity (+400 V) is applied to the first toner charge amount control device 7 by a first power supply S4.

A voltage of a negative polarity (−800 V) is applied to the second toner charge amount control device 8 by a second power supply S5.

A first contact portion E is a region where the first toner charge amount control device 7 is in contact with the surface of the photosensitive drum 1, and among the residual toner including toners of various polarities, a toner of zero or no charge (not charged) or a toner charged to a negative polarity is once adsorbed by the first toner charge amount control device 7.

However, since the amount of toner which can be held by the first toner charge amount control device 7 is limited, the toner absorbed by the first toner charge amount control device 7, after having reached saturation, gradually leaves or peels off therefrom and is attached to and transported by the surface of the photosensitive drum 1. At this time, the toner having left or peeled off in this manner is positively charged, and the distribution of the toner charge amount on the photosensitive drum 1 is made uniform. In this way, the first toner charge amount control device 7 charges toner to a positive polarity which is opposite to the normal polarity, and at the same time, makes the distribution of the toner charge amount uniform.

A second contact portion F is a region where the second toner charge amount control device 8 is in contact with the surface of the photosensitive drum 1, and the residual toner on the photosensitive drum 1 passing through the second toner charge amount control device 8 is charged to a negative polarity which is the normal polarity of the toner.

Since all the residual toner has already been charged to the positive polarity by the first toner charge amount control device 7, a potential difference between the residual toner thus positively charged and the second toner charge amount control device 8 to which a voltage of the negative polarity is applied becomes large, and hence it is easier to generate a discharge therebetween, so that the residual toner on the photosensitive drum 1 can be charged to the negative polarity more effectively.

Thus, by charging the toner remaining after being transferred to the negative polarity, which is the normal polarity of the toner, by means of the second toner charge amount control device 8, reflective power of the residual toner with respect to the photosensitive drum 1 is increased at the time when the surface of the photosensitive drum 1 is charged by the laser beam scanner 3 through the negatively charged residual toner at the charging portion A downstream of the second contact portion F. As a result, it is possible to prevent the residual toner from attaching to the charging roller 2. Further, since the residual toner is charged to the normal polarity, the developing sleeve 4*b* can efficiently collect the residual toner.

Although in this embodiment, a structure including the plurality of toner charge amount control devices 7, 8 has been described, an image forming apparatus may be constructed such that it includes only a single toner charge amount control device as long as the single toner charge amount control device can uniformly charge the residual toner to the normal polarity.

Now, collection of the residual toner in the developing process will be described.

As described above, the developing device 4 is in the form of a cleaner-less system in which it collects the residual toner from the photosensitive drum 1 simultaneously with the development. In order to make the residual toner on the photosensitive drum 1 collected by the developing device 4, it is desirable that the amount of charge of the toner be appropriate.

However, the residual toner, having been excessively charged to the negative polarity by the second toner charge amount control device 8 so as to prevent the toner from attaching to the charging roller 2, may sometimes become unable to be easily collected by the developing device 4. Thus, in order to more efficiently collect the residual toner in the developing device 4, it is preferred that the residual toner excessively charged to the negative polarity by the second toner charge amount control device 8 be diselectrified by the charging roller 2.

Here, note that not only a DC voltage but also an AC voltage (frequency f: 1,000 Hz, and Vpp: 1,400V) is applied to the charging roller 2 so as to charge the circumferential surface of the photosensitive drum 1. The charge of the residual toner is removed, during passage through the charging roller 2, under the action of the AC voltage applied to the charging roller 2. Therefore, in the developing process, the residual toner on the photosensitive drum 1, which should not be developed, is collected by the developing device 4 for the above reason.

What has been described above is an operational mechanism of the image forming apparatus of the cleaner-less system in its steady state.

However, toner trapped to some extent by a physical force or the like in the first and second toner charge amount control devices 7, 8 may be expelled onto the photosensitive drum 1 upon start-up of the image forming apparatus. Since the charge amount of toner expelled onto the photosensitive drum 1 in this manner is not controlled, the toner attaches to the charging roller and causes contamination at the transfer portion, thus resulting in a poor image.

Next, reference will be made to a relationship between a method of applying a bias voltage from the power supply S4 to the first toner charge amount control device 7 and the toner expelled from the first toner charge amount control device 7.

Figure 3:
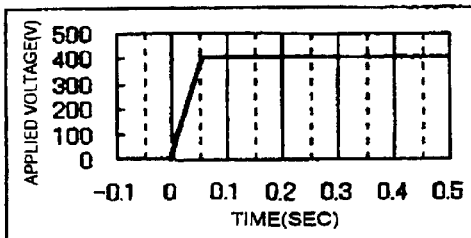
FIG. 3 is a table illustrating measurement results with regard to the relationship between the slope of a bias voltage applied to a first toner charge amount control device and whether toner has been expelled or not.
Figure 3:
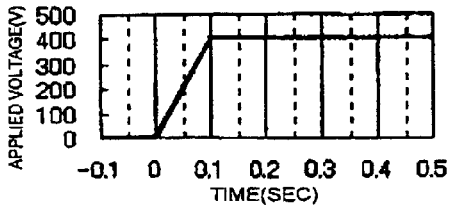
Figure 3:
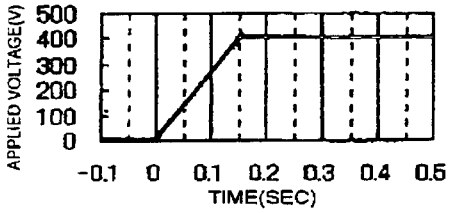
Figure 3:
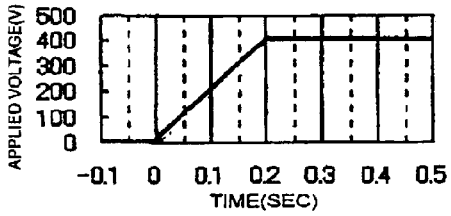
Figure 3:
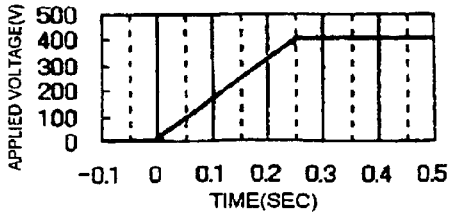

FIG. 3 is a table illustrating measurement results of a period of time until the bias voltage applied to the first toner charge amount control device 7 comes into a steady state, the slope of the bias voltage, and the presence or absence of the toner expelled from the first toner charge amount control device 7.

The DC bias voltage in its steady state applied to the first toner charge amount control device 7 is +400 V. From the results shown in FIG. 3, it is found that when the period of time from the point at the start of application of the bias voltage to the point in time at which a predetermined bias voltage of +400 V is applied to the first toner charge amount control device 7 is 0.2 seconds or longer, toner was not expelled from the first toner charge amount control device 7. The slope of the applied bias voltage at this point is less than or equal to 2,000 V/sec.

Then, similar experiments were performed with respect to the second toner charge amount control device 8.

Figure 4:
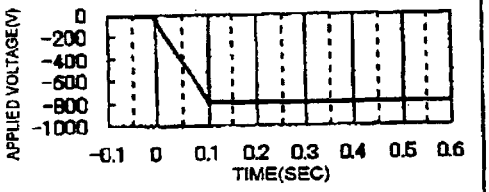
FIG. 4 is a table illustrating measurement results with regard to the relationship between the slope of a bias voltage applied to a second toner charge amount control device and whether toner is expelled or not.
Figure 4:
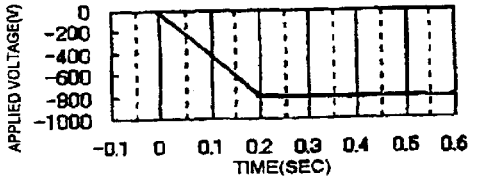
Figure 4:
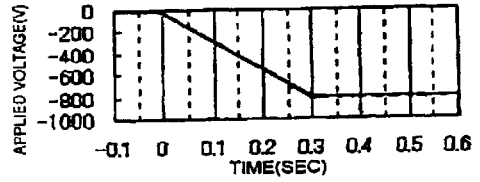
Figure 4:
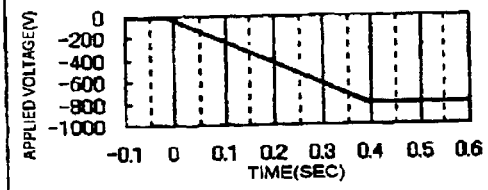
Figure 4:
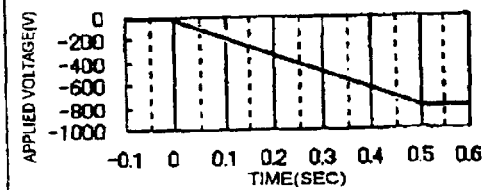

FIG. 4 is a table illustrating measurement results of a period of time until a bias voltage applied to the second toner charge amount control device 8 comes into a steady state, the slope of the bias voltage, and the presence or absence of the toner expelled from the second toner charge amount control device 8.

The bias voltage in its steady state applied to the second toner charge amount control device 8 is −800 V. From the results shown in FIG. 4, it is found that when the period of time from the start of application of the bias voltage to the point in time at which a predetermined bias voltage of −800 V is applied to the second toner charge amount control device 8 is 0.4 seconds or longer, toner was not expelled from the second toner charge amount control device 8. The slope of the applied bias voltage at this point is greater than or equal to −2,000 V/sec (i.e., less than or equal to 2,000 V/sec).

From the above results, it is found that when the absolute value of the slope of the applied bias voltage is less than or equal to 2,000 V/sec, the toner expelled from the toner charge amount control devices 7, 8 is suppressed.

Figure 5:
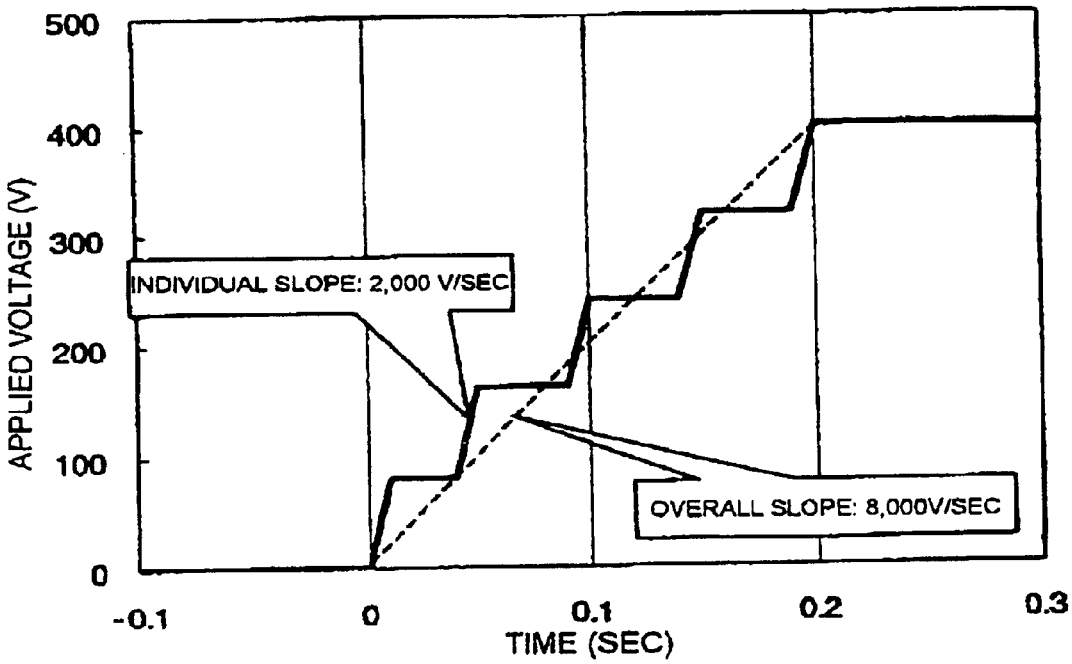
FIG. 5 is a relational view illustrating a difference between an overall or total bias voltage application slope and individual bias voltage application slopes.

On the other hand, as illustrated in FIG. 5, it is verified that even though the slope of the overall bias voltage applied during the rising of the bias voltage is 2,000V/sec, if an individual slope of the applied bias voltage is 8,000 V/sec, toner was expelled.

As described above, in the image forming apparatus according to the present invention, when a bias voltage starts to be applied to each toner charge amount control device during the time a region of the photosensitive drum 1, which is to be an image forming area thereof, exists in a contact position (toner charging position) of the toner charge amount control device, the absolute value of the slope of an applied DC bias voltage is less than or equal to 2,000 V/sec. That is, it is set to a first slope value for a first toner charge amount control member, and to a third slope value for a second toner charge amount control member. In this connection, note that the first slope value may be the same as the third slope value. As a result, the bias voltages can be applied without expelling developer trapped in each developer charge amount control device, whereby occurrence of a poor image can be suppressed. In addition, it is preferable that the periods of time, during which the bias voltages rise at the first and third slope values to their predetermined steady-state levels, respectively, be set to values which are less than or equal to the time required for the photosensitive drum 1 to make a revolution.

However, since the amount of toner which can be held at one time by each toner charge amount control device is limited, it is preferable for the toner to be periodically expelled therefrom to the surface of the photosensitive member or drum.

Accordingly, in this embodiment, during the time a region of the photosensitive drum 1, which is to be an image non-forming area thereof, exists in a contact position (toner charging position) of each toner charge amount control device, a bias voltage is applied to the toner charge amount control device at appropriate timing which does not affect image formation (for example, an image non-forming period such as a pre-rotation period, an interpaper (paper-to-paper) interval, etc.) in such a manner that the absolute value of the slope of the bias voltage applied becomes greater or equal to 2,000 Vsec. That is, the absolute value of the slope of the bias voltage is set to a second slope value larger than the first slope value for the first toner charge amount control member, and to a fourth slope value larger than the third slope value for the second toner charge amount control member. In this connection, note that the second slope value may be the same as the fourth slope value.

By application of such bias voltages, the toner held by each developer charge amount control device can be expelled onto the surface of the photosensitive member or drum (region constituting the image non-forming area or toner expelling area), so that the amount of toner held by the developer charge amount control device can be reduced below a prescribed value, thereby making it possible to maintain the state where contamination by the toner is difficult to take place and defective charging does not occur. Therefore, it is possible to maintain good charging capability of each developer charge amount control device for an extended period of time, thus enabling formation of high quality images, in comparison with the case where such expellation of the toner (i.e., transfer of the toner from each developer charge amount control device to the photosensitive drum 1) with the slope of the applied bias voltage being varied is not carried out.

As explained in the foregoing, an image forming apparatus according to the present invention includes power supplies which generate bias voltages of at least two or more kinds of waveforms and selectively apply them to developer (toner) charging members, so that expellation of the toner held by the developer charging members can be thereby controlled to suppress occurrence of poor or defective images.

More specifically, at the time of ordinary image formation (i.e., during the time when a region of the image bearing member, which is to be an image non-forming area thereof, exists at a contact position of each developer charging member), a DC bias voltage with a relatively small application slope is applied to each developer charging member so as to suppress or prevent a large amount of toner from being expelled at one time from each developer charging member, whereas at the time of image non-formation such as a pre-rotation period, an interpaper interval, or the like, a DC bias voltage with a relatively large application slope is applied to transfer toner to the image bearing member so as to prevent the charging capability of each developer charging member from being reduced due to an excessive amount of toner more than that can be held by each developer charging member. As a result, it is possible to prevent poor or defective images due to contamination by toner or the like.

While the invention has been described in terms of a preferred embodiment, those skilled in the art will recognize that the invention can be practiced with modifications within the spirit and scope of the appended claims.

What is claimed is:

1. An image forming apparatus comprising:

an image bearing member;

a charging device for charging said image bearing member;

a developing device for developing an electrostatic image formed on said image bearing member with developer to form a developer image;

a transfer device for transferring said developer image from said image bearing member onto an image receiving member; and a developer charging member for charging residual developer on said image bearing member, said developer charging member being disposed in contact with said image bearing member at a location on the downstream side of said transfer device and on the upstream side of said charging device in a moving direction of said image bearing member;

wherein a DC voltage applied to said developer charging member has a slope at the start of the application of said DC voltage, and an absolute value of the slope is selectable from a first value and a second value which is greater than said first value.

2. The image forming apparatus as set forth in claim 1, wherein said first value is less than or equal to 2,000 V/sec.

3. The image forming apparatus as set forth in claim 2, wherein when said first value is selected, a rising period of time at the start of the application of said DC voltage is less than or equal to the time required for said image bearing member to make a revolution.

4. The image forming apparatus as set forth in claim 2, wherein said second value is greater than 2,000 V/sec.

5. The image forming apparatus as set forth in any one of claims 1 through 4, when a position at which said developer charging member is in contact with said image bearing member is a region which is to be an image forming area of said image bearing member, said first value is selected, whereas when said position at which said developer charging member is in contact with said image bearing member is a region of said image bearing member to which said developer is made to transfer from said developer charging member, said second value is selected.

6. The image forming apparatus as set forth in claim 1, wherein said charging device is provided with a contact charging member which can be in contact with said image bearing member so as to charge said image bearing member.

7. The image forming apparatus as set forth in claim 6, wherein said contact charging member is applied with a voltage which is formed by superimposing an AC voltage on a DC voltage.

8. The image forming apparatus as set forth in claim 1, wherein said developer charging member comprises a fiber brush member.

9. The image forming apparatus as set forth in claim 1, wherein said developer charging member charges said residual developer to a normal charging polarity of said developer.

10. The image forming apparatus as set forth in claim 1, wherein said developing device is capable of performing collecting operation for collecting said residual developer from said image bearing member simultaneously with developing operation.

11. The image forming apparatus as set forth in claim 10, wherein said charging device has the same charging polarity as a normal charging polarity of said developer.

12. An image forming apparatus comprising:

an image bearing member;

a charging device for charging said image bearing member;

a developing device for developing an electrostatic image formed on said image bearing member with developer to form a developer image;

a transfer device for transferring said developer image from said image bearing member onto an image receiving member; and a first developer charging member for charging residual developer on said image bearing member, said first developer charging member being disposed in contact with said image bearing member at a location on the downstream side of said transfer device and on the upstream side of said charging device in a moving direction of said image bearing member, a first DC voltage of a polarity opposite to a normal charging polarity of said developer being applied to said first developer charging member; and a second developer charging member for charging said residual developer on said image bearing member, said second developer charging member being disposed in contact with said image bearing member at a location on the downstream side of said first developer charging member and on the upstream side of said charging device in the moving direction of said image bearing member, a second DC voltage of the same polarity as the normal charging polarity of said developer being applied to said second developer charging member;

wherein said first DC voltage has a first slope at the start of the application of said first DC voltage, and an absolute value of the first slope is selectable from a first value and a second value which is greater than said first value, and said second DC voltage has a second slope at the start of the application of said second DC voltage, and an absolute value of the second slope is selectable from a third value and a fourth value which is greater than said third value.

13. The image forming apparatus as set forth in claim 12, wherein each of said first and third values is less than or equal to 2,000 V/sec.

14. The image forming apparatus as set forth in claim 13, wherein when said first and third values are selected, a rising period of time at the start of the application of each of said first and second DC voltages is less than or equal to the time required for said image bearing member to make a revolution.

15. The image forming apparatus as set forth in claim 13, wherein each of said second and fourth values is greater than 2,000 V/sec.

16. The image forming apparatus as set forth in any one of claims 12 through 15, when a position at which each of said first and second developer charging members is in contact with said image bearing member is a region which is to be an image forming area of said image bearing member, said first and third values are selected, whereas when said position at which each of said first and second developer charging members is in contact with said image bearing member is a region of said image bearing member to which said developer is made to transfer from said first and second developer bearing members, said second and fourth values are selected.

17. The image forming apparatus as set forth in claim 12, wherein said charging device is provided with a contact charging member which can be in contact with said image bearing member so as to charge said image bearing member.

18. The image forming apparatus as set forth in claim 17, wherein said contact charging member is applied with a voltage which is formed by superimposing an AC voltage on a DC voltage.

19. The image forming apparatus as set forth in claim 12, wherein each of said first and second developer charging members comprises a fiber brush member.

20. The image forming apparatus as set forth in claim 12, wherein said developing device is capable of performing collecting operation for collecting said residual developer from said image bearing member simultaneously with developing operation.

21. The image forming apparatus as set forth in claim 20, wherein said charging device has the same charging polarity as a normal charging polarity of said developer.

* * * * *

UNITED STATES PATENT AND TRADEMARK OFFICE

CERTIFICATE OF CORRECTION

PATENT NO. : 6,944,416 B2
DATED : September 13, 2005
INVENTOR(S) : Yasunari Watanabe It is certified that error appears in the above-identified patent and that said Letters Patent is hereby corrected as shown below:

Drawings,
Sheet 3, Figure 3 and Sheet 4, Figure 4, “BICOMES” should read -- BECOMES --.

Column 3,
Line 28, “the cause of” should read -- in --; and
Line 66, “and” should be deleted.

Column 4,
Line 55, “photo” should read -- photo- --.

Column 6,
Line 66, “to slides” should read -- so as to slide --.

Column 7,
Line 53, “During” should read -- While --.

Column 9,
Line 14, “once” should read -- first --.

Signed and Sealed this

Thirty-first Day of January, 2006

JON W. DUDAS
*Director of the United States Patent and Trademark Office*